US005214449A

United States Patent [19]

Buhler

[11] Patent Number: 5,214,449

[45] Date of Patent: May 25, 1993

[54] THERMAL INK JET BUBBLE CONTAINMENT CHAMBER DESIGN FOR ACOUSTIC ABSORPTION

[75] Inventor: Steven A. Buhler, Redondo Beach, Calif.

[73] Assignee: Xerox Corporation, Stamford, Conn.

[21] Appl. No.: 724,678

[22] Filed: Jul. 2, 1991

[51] Int. Cl.[5] ..... B41J 2/05

[52] U.S. Cl. ..... 346/140 R

[58] Field of Search ..... 346/140

[56] References Cited

U.S. PATENT DOCUMENTS 4,502,060 2/1985 Rankin ..... 346/140 R
4,694,308 9/1987 Chan ..... 346/140 R
5,041,844 8/1991 Deshpande ..... 346/140 R X

FOREIGN PATENT DOCUMENTS 139455 7/1985 Japan .

OTHER PUBLICATIONS

Lane et al.; Resonant Sound-Absorbing Liner For Ink Jet Heads; IBM Tech. Disc. Bulletin, V/7, Nu, Apr. 1975, p. 3455.

*Primary Examiner*—Joseph W. Hartary
*Attorney, Agent, or Firm*—Fariba K. Rad

[57] ABSTRACT

A thermal ink jet printhead with a plurality of newly designed bubble containment chambers for reducing a spattering effect which is the ejection of unwanted small aerosol type droplets after the ejection of an ink drop. The printhead has one or more ink channels each having an opening at one end, known as nozzle, and also having a bubble containment chamber for each channel at a predetermined distance from the nozzle. The new bubble containment chamber is designed to absorb or redirect undesired acoustic waves produced from the collapse of a bubble in the bubble containment chamber which in turn causes the ejection of unwanted small aerosol type droplets after the ejection of an ink drop. The bubble containment chamber of this design absorbs or redirects the acoustic energy by having four different kinds of wedges on its walls.

17 Claims, 2 Drawing Sheets

THERMAL INK JET BUBBLE CONTAINMENT CHAMBER DESIGN FOR ACOUSTIC ABSORPTION

BACKGROUND OF INVENTION AND SUMMARY

This invention relates generally to a design of a thermal ink jet bubble containment chamber and more particularly concerns a containment chamber for absorbing or redirecting acoustic energy.

Generally, an ink jet printing system has a printhead which comprises one or more ink filled channels, communicating with an ink supply chamber at one end and having an opening at the opposite end, referred to as a nozzle. A heating element, usually a resistor, is placed at the bottom of a bubble containment chamber which in turn is located at a predetermined distance from the nozzle. A flow of an electric current heats up the heating element vaporizing the ink in the chamber and forming a bubble. As the bubble grows, the ink is ejected out of the nozzle. By stopping the current flow, the heating element cools off causing the bubble to collapse. While the bubble is collapsing, the ink at the vicinity of the nozzle is pulled in resulting in drop ejection by separation of the ink outside of the nozzle from the ink inside of the nozzle.

It is known in thermal ink jet printing that deposits of dried ink which accumulate at or near the nozzle exit cause the drop ejection accuracy to decrease. The deposits of dried ink are called spattering and are one of the most important factors affecting directionality of the drop ejection. These deposits on the ejection face must be periodically cleaned off as an element of system maintenance. Whether this is done manually or by maintenance station internal to the system, the reduction or elimination of spattering would be highly advantageous. It is observed that the ink on the ejection surface accumulates from very small, aerosol type droplets.

The energy which creates these droplets is acoustic since the collapse of the bubble in the containment chamber is known to proceed to strong cavitation. Indeed, this is the cause of the erosion of the heating element and necessitates the protection of this element with a very strong layer which is, typically, Tantalum. Microphotography indicates that the small problem droplets (spattering) occur when the bubble collapses.

The object of this invention is to eliminate as much as possible the spattering effect. This object is achieved by having the walls of the bubble containment chamber built to have some jagged wedges to absorb or redirect undesired acoustic waves. In a preferred embodiment, four different groups of wedges are built on the walls of the chamber: long wedges located at the rear, opposite to the nozzle exit, dispersive wedges located on the side walls at the front of the chamber close to the nozzle exit, a wide wedge located on the front wall of the chamber and side angle wedges located on the side walls which are adjacent to the dispersive wedges. Each group of wedges serves a different purpose in absorbing or redirecting the undesired acoustic waves.

DESCRIPTION OF THE INVENTION

Figure 1:
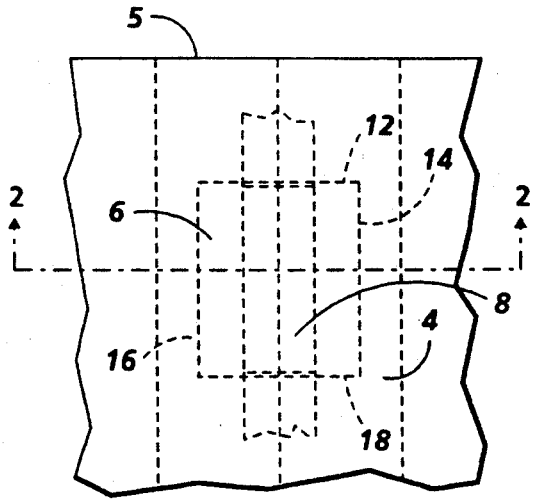
FIG. 1 (PRIOR ART)
FIG. 1 is a top view of a prior art single nozzle of a print head.
Figure 2:
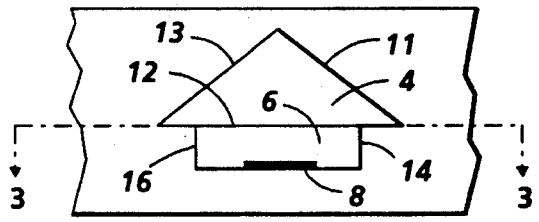
FIG. 2 (PRIOR ART)
FIG. 2 is a view taken along the section line 2—2 in FIG. 1.
Figure 3:
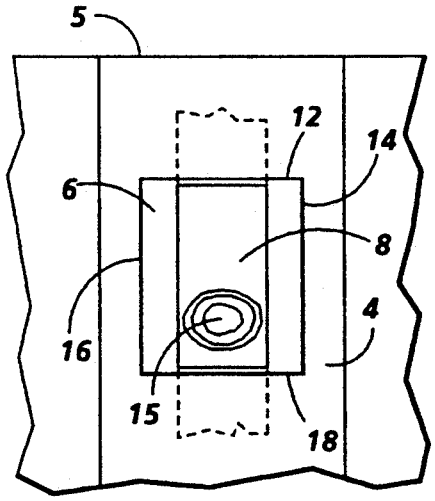
FIG. 3 (PRIOR ART)
FIG. 3 is a view taken along the section line 3—3 in FIG. 2.

Referring to FIGS. 1, 2 and 3, there are shown different views of a prior art single nozzle of a multi-nozzle printhead (made of any well known type of semiconductor material) which comprises one or more ink filled channels 4, having an opening at one end, referred to as nozzle 5, and communicating with an ink supply chamber (not shown) at the opposite end. A bubble containment chamber 6 is located near the nozzle 5 at a predetermined distance therefrom and a heating element 8, such as a resistor, is located at the bottom of the containment chamber 6.

Considering wall 12, which is near the nozzle 5, to be the front wall and the opposite wall 18 to be the rear wall, the center of acoustic energy 15 is shown to be at the rear half of the chamber 6. Since the collapse of a bubble in the containment chamber 6 is known to proceed to strong cavitation in the rear half of the chamber, it is believed that the center of acoustic energy is in the spot that cavitation occurs. This energy not only causes the erosion of the heating element through the cavitation, it also causes the generation of the droplets. The waves generated from the acoustic energy travel in all directions and the waves at the front end of the channel 4 strike the channel walls 11 and 13 and reflect toward the nozzle 5 and cause the ejection of the unwanted droplets after the ink ejection.

Figure 4:
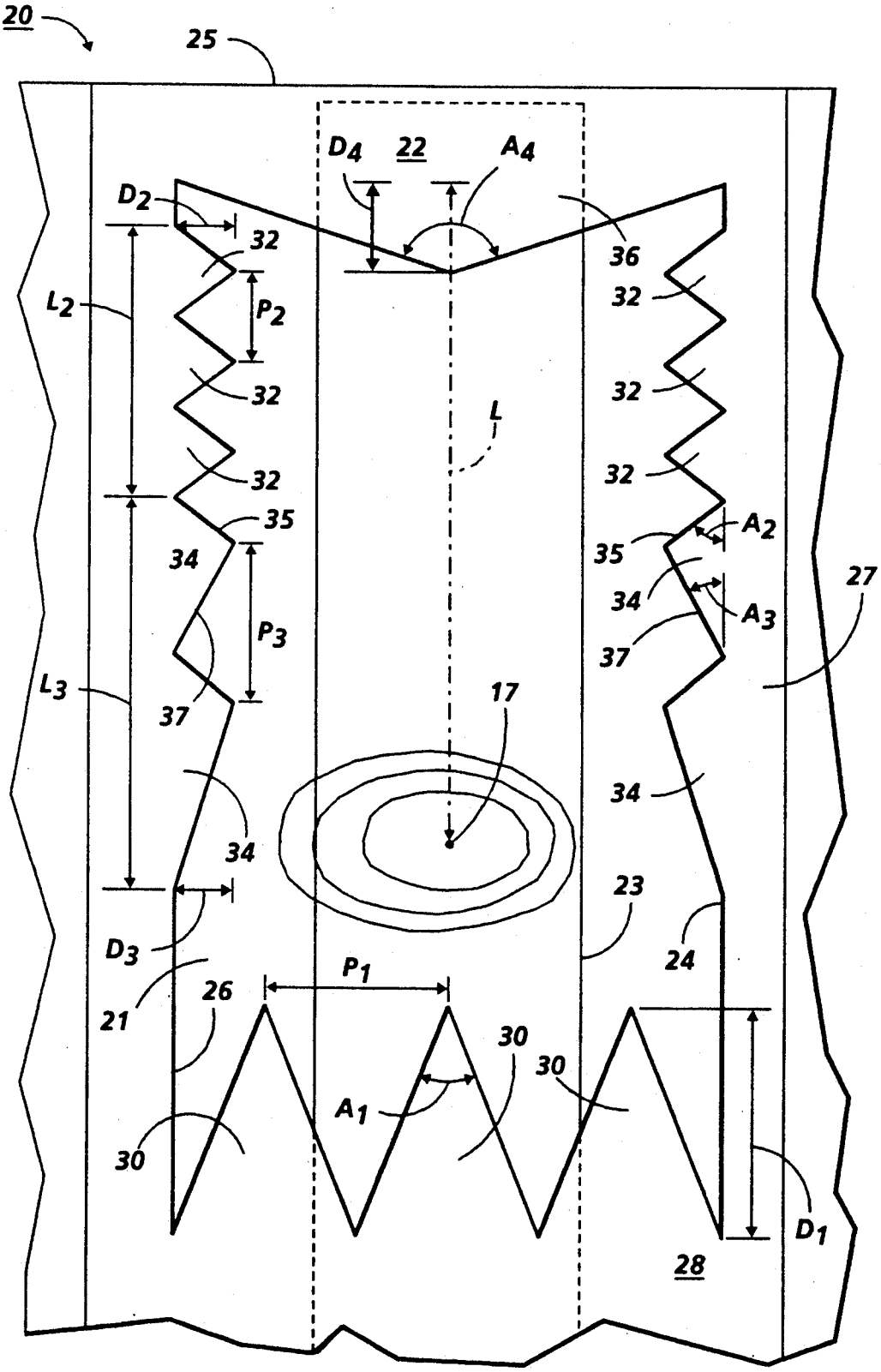
FIG. 4 is a view similar to FIG. 3 but of the bubble containment chamber of this invention.

Referring to FIG. 4, there is shown a design of a bubble containment chamber 21 of a single nozzle of a multi-nozzle printhead 20 (made of any well known type of semiconductor material) of this invention which is capable of absorbing and redirecting the undesired acoustic waves generated from the collapse of a bubble in the chamber 21 away from the nozzle 25. The heating element 23 is the same as the heating element 8 shown in FIGS. 1, 2 and 3 and the center of acoustic energy 17 is the same as the center of acoustic energy 15 illustrated in FIGS. 1, 2 and 3. In contrast to the smooth walls 12, 14, 16 and 18 of the prior art bubble containment chamber 6 shown in FIGS. 1, 2 and 3, the walls 22, 24, 26 and 28 of the bubble containment chamber 21 of this invention, shown in FIG. 4, are built to have jagged wedges extending therefrom into the containment chamber 21. Four different groups of wedges are built on the walls of the chamber 21 of this invention: long wedges 30 on the rear wall 28, angle wedges 34 on the side walls 24 and 26, dispersive wedges 32 on the side walls 24 and 26 which are adjacent to the angle wedges 34 and located between the angle wedges 34 and the front wall 22, and a wide wedge 36 located on the front wall 22. The shapes, the lengths and the angles of each group of wedges are designed to serve a different purpose in absorbing or redirecting the waves. Of course, it should be understood that due to the limitations of the process in making precise angles, in reality, all the sharp peaks of the wedges shown in FIG. 4 are rounded.

The longer wedges 30, which are more effective in absorbing or redirecting the waves, are designed to be on the rear wall and the smaller wedges are designed to be on the front portion of the side walls. Since the center of acoustic energy is located at the rear half of the chamber 21, the rear wall 28 receives the waves which are close to the center of energy 17 and therefore are stronger. On the other hand the front wall 22 and the front portion of the side walls 24 and 26, due to being a further distance away from the center of energy 17, receive waves that have lost some energy.

The wedges 30 are made to be long and narrow to absorb or redirect the acoustic energy toward the rear of the channel 27. Depending on the wave length, the distance $D_1$ between the apex and the base of each wedge 30 should be generally between the range of 30–100 microns, but at least ¼ of the maximum wave length of the acoustic energy in the liquid ink. Pitch $P_1$, the distance between each two adjacent peaks of adjacent wedges 30, is selected to be generally between the range of 20–50 microns and the maximum angle $A_1$ of the apex of each wedge 30 should generally be 60 degrees which is small enough to trap some waves and is also capable of deflecting the untrapped waves to the rear of the channel 27 rather than back into the chamber 21. The trapped waves initially encountering the wedges 30 start bouncing between the walls of the wedges 30 until they are finally absorbed.

Dispersive wedges 32 are located on the front portions of the side walls 24 and 26 between the front wall 22 and angle wedges 34. These groups of wedges are specifically designed to disturb the orderly pattern of the wave movement in the front portion of the containment chamber 21. To be able to disperse and redirect these waves away from the nozzle 25, the distance $D_2$ between the apex and the base of each wedge 32 should be compatible with the wavelength of the acoustic waves. For this purpose, $D_2$ is designed to be generally between the range of 10–20 microns which is effective in dispersing the acoustic waves. Also, pitch $P_2$, the distance between each two adjacent peaks of adjacent wedges 34, is designed to be generally between the range of 10–20 microns. The ratio of the length $L_2$ of the group of wedges 32 to the distance L between the center of acoustic energy 17 to the base of the front wall 22 (also the base of the front wedge 36) ($L_2/L$) is designed to be generally between the range of 0.5–0.8.

Angle wedges 34 are located on the side walls 24 and 26 adjacent to the dispersive wedges 32 and between the dispersive wedges 32 and the center of acoustic energy 17. These groups of wedges 34 are formed to each have a short front side 35 and a long rear side 37. The short side 35 is at a greater angle $A_2$ with the base of the wedge than the angle $A_3$ that the longer side 37 is with the base. The long sides 37 are designed to retard the waves by reflecting them back to the rear of channel 27 and chamber 21. The distance $D_3$ between the apex and the base of each wedge 34 is generally between the range of 10–20 microns. Also, the pitch $P_3$ of these wedges 34 is selected to be 2–5 times longer than the pitch $P_2$ of the dispersive wedges 32. The ratio of the length $L_3$ of the group of wedges 34 to the distance L between the center of acoustic energy 17 to the base of the front wall 22 (also the base of the front wedge 36) ($L_3/L$) is designed to be generally between the range of 0.2–0.5.

Wide wedge 36 is a single wedge located at the front wall of the chamber 21. This wedge receives waves from the center of the energy and some scattered waves from dispersive wedges 32. The angle of the apex $A_4$ of this wedge 36 should be generally between the range of 90–150 degrees to redirect the waves to the corners of the chamber 21 and away from the nozzle 25. Consequently, the distance $D_4$ between the apex and the base of wedge 36 is controlled by the length of the front wall 22 and the apex angle of the wedge 36.

The above embodiment is the preferred embodiment. However, it should be understood that each group of wedges individually is effective in reducing the acoustic energy and thus spattering, with long wedges 30 being the most effective and the dispersive wedges 32 being the next most effective.

As an alternative to the embodiment described in FIG. 4, the walls of the bubble containment chamber can be built as steps which can allow for optimum wedge sizes. In this embodiment, the bubble containment chamber is made of two layers. A first layer of polyimide is deposited on a heating element wafer to protect the electronics. This layer is etched to provide an opening for the heating element and serves as the bottom portion of the bubble containment chamber. Then the first layer is cured before depositing a second layer of polyimide on top of the first layer. The second layer of polyimide can be etched without damaging the first layer since the first layer is already cured. The wedges are etched on the walls of the bubble containment chamber on the second layer which forms the upper portion of the bubble containment chamber. The first layer can be etched to have a required size opening just to expose the heating element while covering the electronics connected to the heating element to prevent damage. Then the second layer can be etched to have a larger opening which in turn provides flexibility in selecting the optimum wedge sizes.

The described embodiment of FIG. 4 can be implemented in roof shooter printheads, in which a bubble containment chamber is located under a nozzle and a heating element is placed at the bottom of the containment chamber and is in a plane perpendicular to the exit of a drop and aligned with the nozzle. The bubble containment chamber of this kind of printhead can be circular, square or rectangular. Wedges similar to those described in the embodiment of FIG. 4 can be made on the circular wall or the square or rectangular walls of the bubble containment chamber of a roof shooter printhead.

What is claimed is:

1. In a thermal ink jet:

a fluid drop ejection nozzle;

a heating element for generating a bubble;

a bubble containment chamber located adjacent said nozzle comprising a front wall, a first side wall, a second side wall and a rear wall;

acoustic energy being generated upon collapse of a generated bubble; and at least one of said walls having wedge means extending into said containment chamber thereon so constructed and arranged for redirecting acoustic energy generated from the collapse of a bubble in said containment chamber.

2. The structure as recited in claim 1, wherein said at least one of said walls is said rear wall.

3. The structure as recited in claim 2, wherein said wedge means comprises a plurality of rear wedges, each said rear wedge has a distance between its apex and its base generally between a range of 30–100 microns, the pitch between adjacent said rear wedges is generally between a range of 20–50 microns and the maximum apex angle is generally 60 degrees.

4. The structure as recited in claim 1, wherein said wedge means is on said first side wall and said second side wall.

5. The structure as recited in claim 4, wherein said wedge means comprises a plurality of wedges, each said wedge has a distance between its apex and its base generally between a range of 10–20 microns, and the pitch between adjacent said wedges is generally between a range of 10–20 microns.

6. The structure as recited in claim 4, wherein said wedge means comprises a plurality of first wedges and a plurality of second wedges adjacent to said first wedges and located between said rear wall and said first wedges, each said first wedge has a distance between its apex and its base generally between a range of 10–20 microns, the pitch between adjacent said first wedges is generally between a range of 10–20 microns and each said second wedge has a distance between its apex and its base generally between a range of 10–20 microns, and the pitch between adjacent said second wedges is generally 2–5 times said pitch between adjacent said first wedges.

7. The structure as recited in claim 6, wherein said first wedge means and said second wedge means are on said side walls between said front wall and the center of acoustic energy.

8. The structure as recited in claim 7, wherein the ratio of the length of the group of said first wedge means on one wall to the distance between the center of acoustic energy and the base of said front wall is generally between a range of 0.5–0.8 and the ratio of the length of the group of said second wedge means on one wall to the distance between the center of acoustic energy and the base of said front wall is generally between a range of 0.2–0.5.

9. The structure as recited in claim 1, wherein said at least one of said walls is said front wall and said wedge means is one wedge.

10. The structure as recited in claim 9, wherein said wedge means has an apex angle generally between a range of 90–150 degrees.

11. The structure as recited in claim 1, wherein said wedge means is on said rear wall, said first side wall and said second side wall.

12. The structure as recited in claim 11, wherein said wedge means comprises a plurality of rear wedges on said rear wall, a plurality of first wedges and a plurality of second wedges on each of said side walls, said plurality of second wedges being adjacent to said first wedges and located between said rear wall and said first wedges, each said rear wedge has a distance between its apex and its base generally between a range of 30–100 microns, the pitch between adjacent said rear wedges is generally between a range of 20–50 microns and the maximum apex angle is generally 60 degrees, each said first wedge has a distance between its apex and its base generally between a range of 10–20 microns, the pitch between adjacent said first wedges is generally between a range of 10–20 microns and each said second wedge has distance between its apex and its base generally between a range of 10–20 microns, and the pitch between adjacent said second wedges is generally 2–5 times said pitch between adjacent said first wedges.

13. The structure as recited in claim 11, wherein said wedge means comprises a plurality of wedges extending into said containment chamber and each said wedge on the rear wall has a distance between its apex and its base which is greater than the distance between the apex and the base of each wedge on each side wall.

14. The structure as recited in claim 1, wherein said wedge means is on said rear wall, said first side wall, said second side wall and said front wall.

15. The structure as recited in claim 14, wherein said wedge means comprises a plurality of rear wedges on said rear wall, a plurality of first wedges and a plurality of second wedges on each of said side walls, and a wedge on said front wall, said plurality of second wedges being adjacent to said first wedges and located between said rear wall and said first wedges, each said rear wedge has a distance between its apex and its base generally between a range of 30–100 microns, the pitch between adjacent said rear wedges is generally between a range of 20–50 microns and the maximum apex angle is generally 60 degrees, each said first wedge has a distance between its apex and its base generally between a range of 10–20 microns, the pitch between adjacent said first wedges is generally between a range of 10–20 microns and each said second wedge has distance between its apex and its base generally between a range of 10–20 microns, and the pitch between adjacent said second wedges is generally 2–5 times said pitch between adjacent said first wedges, and said front wedge has an apex angle generally between a range of 90–150 degrees.

16. The structure as recited in claim 14, wherein said wedge means comprises a plurality of wedges on said rear and said side walls and a single wedge on said front wall extending into said containment chamber, and each said wedge on the rear wall has a distance between its apex and its base which is greater than the distance between the apex and the base of each wedge on each side wall and of the wedge on said front wall.

17. In a thermal ink jet:

a fluid drop ejection nozzle;

a heating element for generating a bubble;

a bubble containment chamber located adjacent said nozzle comprising wall means; and said wall means having wedge means extending into said containment chamber thereon so constructed and arranged for redirecting acoustic energy generated from the collapse of a bubble in said containment chamber.

* * * * *